US008708194B2

(12) United States Patent
Pascatore

(10) Patent No.: US 8,708,194 B2
(45) Date of Patent: Apr. 29, 2014

(54) DISPENSER WITH MOVABLE DISPENSING COMPONENT ANCHORED BY A FILAMENT

(76) Inventor: Amanda R. Pascatore, Rochester, NY (US)

( * ) Notice: Subject to any disclaimer, the term of this patent is extended or adjusted under 35 U.S.C. 154(b) by 377 days.

(21) Appl. No.: 12/958,208

(22) Filed: Dec. 1, 2010

(65) Prior Publication Data

US 2011/0127293 A1 Jun. 2, 2011

Related U.S. Application Data

(60) Provisional application No. 61/265,710, filed on Dec. 1, 2009.

(51) Int. Cl.
*B65D 37/00* (2006.01)
*B67D 7/60* (2010.01)

(52) U.S. Cl.
USPC ..... 222/1; 222/214; 222/386; 222/392; 222/175; 224/148.2

(58) Field of Classification Search
USPC ..... 222/175, 206, 212, 214, 215, 386, 392; 224/148.1, 148.2; 401/6, 176
See application file for complete search history.

(56) References Cited

U.S. PATENT DOCUMENTS

| | | | | |
|---|---|---|---|---|
| 811,272 | A * | 1/1906 | Belcher | 401/176 |
| 2,856,927 | A * | 10/1958 | Senger | 604/218 |
| 3,231,139 | A * | 1/1966 | Bouet | 222/95 |
| 3,464,592 | A * | 9/1969 | Stroop | 222/82 |
| 3,521,795 | A * | 7/1970 | Bergishagen et al. | 222/386 |
| 3,756,460 | A * | 9/1973 | Hill | 222/1 |
| 4,768,688 | A | 9/1988 | Harrigan | |
| 4,785,973 | A | 11/1988 | Kobe | |
| 4,917,273 | A * | 4/1990 | Seager | 222/392 |
| 5,060,833 | A | 10/1991 | Edison et al. | |
| 5,137,177 | A * | 8/1992 | Willis | 222/1 |
| 5,330,075 | A * | 7/1994 | Brown, Sr. | 222/82 |
| 5,622,293 | A | 4/1997 | LeFevre | |

(Continued)

FOREIGN PATENT DOCUMENTS

| | | | |
|---|---|---|---|
| EP | 0066016 | A1 | 12/1982 |
| JP | 2000-168806 | A | 6/2000 |
| WO | 2006/118479 | A1 | 11/2006 |

OTHER PUBLICATIONS

International Search Report and Written Opinion issued in PCT/US2010/058586, mailed Aug. 31, 2011.

*Primary Examiner* — Kevin P Shaver
*Assistant Examiner* — Patrick M Buechner
(74) *Attorney, Agent, or Firm* — Heslin Rothernberg Farley & Mesiti P.C.; Andrew K. Gonsalves, Esq.

(57) ABSTRACT

The present invention relates a device for storing and dispensing a fluid. The device includes an elongated container, an outlet component, and a movable dispensing component. Also disclosed is a kit that includes the device and a filling attachment for refilling the device with a fluid. Also disclosed is a kit that includes a compilation of component parts comprising the elongated container, the outlet component, and the movable dispensing component of the device. The kit can further include a filament for directly or indirectly anchoring the movable dispensing component to the elongated container. The kit can also include a filling attachment comprising an attachment end and an adapter end. Also disclosed is a method for storing a fluid, a method for dispensing a fluid, and a method for storing, dispensing, and refilling a fluid.

25 Claims, 14 Drawing Sheets

(56) References Cited

U.S. PATENT DOCUMENTS

| | | | | |
|---|---|---|---|---|
| 5,938,363 | A | 8/1999 | Timms et al. | |
| 6,581,811 | B1 | 6/2003 | Schillaci | |
| 2005/0279776 | A1 * | 12/2005 | Decottignies et al. | 222/386 |
| 2008/0251539 | A1 | 10/2008 | Yapaola et al. | |
| 2009/0015000 | A1 | 1/2009 | Wolfe | |
| 2009/0134184 | A1 | 5/2009 | Stollmann et al. | |
| 2012/0138637 | A1 * | 6/2012 | Ciavarella et al. | 222/175 |

* cited by examiner

DISPENSER WITH MOVABLE DISPENSING COMPONENT ANCHORED BY A FILAMENT

CROSS-REFERENCE TO RELATED APPLICATIONS

This application claims priority benefit of U.S. Provisional Patent Application Ser. No. 61/265,710, filed Dec. 1, 2009, which is hereby incorporated by reference herein in its entirety.

FIELD OF THE INVENTION

The present invention relates to a device for storing and dispensing fluids.

BACKGROUND OF THE INVENTION

A large number of consumer products involve fluid or liquid formulations that are topically applied to the body. Some examples of these products include sunscreen, skincare products, body cleansers and sanitizers, personal lubricants, cosmetics, repellents, skin camouflages, and body and face paints. These products are normally sold in a variety of dispensing containers, ranging in size from large, economy-size containers to small, travel-size bottles. However, consumers of these products often find that the existing dispensing containers are inadequate and inconvenient for use while away from the home, office, or other location where these products are normally kept. Even if a product is provided in a travel-size container, such containers are rarely, if at all, convenient or discreet enough to be wearable. Thus, hands-free accessories for carrying consumer products made of viscous fluids are important because of their convenience for consumers.

The wrist is a convenient place to carry items such as the consumer products mentioned above. One reason for this is due to the fact that the wrist is a location that minimizes the time to access the product by hand. As noted below, various inventions have attempted, unsuccessfully, to take advantage of the wrist as a place to carry a container with fluids.

U.S. Pat. No. 6,581,811 discloses a wearable container for flowable materials. The wearable container of U.S. Pat. No. 6,581,811 is intended for food or beverage storage and is deformable axially so that the length and volume of the container can change, and that change can push the flowable material from within. However, the container does not form a continuous cavity and is closed on one end. Also, there is no mechanism for indicating how much of the contents have been dispensed and no dedicated mechanism for sealing and dispensing.

U.S. Pat. No. 4,702,473 discloses a combination hand weight and water dispenser. The container of U.S. Pat. No. 4,702,473 is intended for beverage storage and is handheld and not wearable.

U.S. Pat. No. 4,768,688 discloses a suntan lotion bracelet. The wearable container of U.S. Pat. No. 4,768,688 is a rigid tube that maintains its shape and has caps to close the container and dispense the contents. However, there is no mechanism for dispensing besides squeezing the container, no indicator of how much of the contents have been dispensed, and the open cap is for filling and dispensing.

U.S. Pat. No. 5,060,833 discloses a wearable collapsible container for dispensing drinking water. This collapsible container is worn using straps.

U.S. Pat. No. 5,207,362 discloses a wearable container for dispensing liquid for drinking. It is a tube worn around the neck having a straw inserted therein.

U.S. Pat. No. 5,261,570 discloses a flexible, wearable liquid dispenser. The dispenser of U.S. Pat. No. 5,261,570 is intended for lotions and other liquids. It is a hollow molded plastic form with a cap. It is meant to be squeezed to dispense the contents. However, it is not for wearing on the wrist nor is there a mechanism for dispensing other than squeezing the container, no indicator of how much of the contents has been dispensed, and the open cap is for filling and dispensing.

U.S. Pat. No. 5,431,308 discloses an apparatus for storing and dispensing fluids for use by an athlete. It is a hollow tube with closed ends.

U.S. Pat. No. 5,622,293 discloses a wearable liquid container. It is a flexible tube with two ends that connect to form a loop. However, only one of the ends is open for receiving and dispensing liquids and an exterior connecting member keeps the ends together.

To date, nothing in the prior art has been described that is mechanically effective as both a viscous fluid container and a dispenser, and that solves the functional challenges of being refillable, virtually spill-proof, wearable, discreet, and able to be manufactured in many different colors and styles, and therefore wearable in many circumstances. Therefore, there is a need for a wearable device for storing and dispensing fluids such as the consumer products mentioned above.

The present invention is directed to overcoming these and other deficiencies in the art.

SUMMARY OF THE INVENTION

In one aspect, the present invention relates a device for storing and dispensing a fluid. The device includes an elongated container, an outlet component, and a movable dispensing component. The elongated container includes a hollow body having a first end and a second end. The outlet component is directly or indirectly attached to the first end of the elongated container. The outlet component is effective as a conduit for dispensing the fluid from the elongated container. The movable dispensing component is effective for manipulating the fluid through the elongated container and for dispensing the fluid from the outlet component. The movable dispensing component is configured to be movably disposed within the container. The device of the present invention can further include one or more embellishment selected from the group consisting of charms, stones, gems, ornaments, precious metals, and the like.

In another aspect, the present invention relates to a kit that includes the device of the present invention and a filling attachment. The filling attachment includes an attachment end and an adapter end. The attachment end is configured to insert a fluid into the elongated container. The adapter end is configured to connect to a reservoir containing the fluid prior to the fluid being inserted into the elongated container. The kit can further include one or more embellishment selected from the group consisting of charms, stones, gems, ornaments, precious metals, and the like.

In yet another aspect, the present invention relates to a kit that includes a compilation of component parts comprising the elongated container, the outlet component, and the movable dispensing component of the device of the present invention. The kit can further include a filament for directly or indirectly anchoring the movable dispensing component to the elongated container. The kit can also include a filling attachment comprising an attachment end and an adapter end. The attachment end is configured to insert a fluid into the elongated container. The adapter end is configured to connect to a reservoir containing the fluid prior to the fluid being inserted into the elongated container. The kit can further include one or more embellishment selected from the group consisting of charms, stones, gems, ornaments, precious metals, and the like.

In another aspect, the present invention relates to a method for storing a fluid. This method involves providing a device of the present invention. The device contains the fluid and is provided so that the first end and second end of the elongated container of the device are connected so as to form a closed ring-like structure, thereby storing the fluid.

In still another aspect, the present invention relates to a method for dispensing a fluid. This method involves providing a device of the present invention. The device contains the fluid and is provided so that the first end and second end of the elongated container are not connected. Thereafter, the movable dispensing component is manipulated in a direction toward the first end of the elongated container so that the fluid is expelled from the outlet component.

In yet another aspect, the present invention relates to a method for storing, dispensing, and refilling a fluid. This method involves providing a device of the present invention. The device contains the fluid and is provided so that the first end and second end of the elongated container are connected so as to form a closed ring-like structure, thereby storing the fluid. Thereafter, the first end and second end of the elongated container are disconnected. The movable dispensing component is then manipulated in a direction toward the first end of the elongated container so that the fluid is expelled from the outlet component. The elongated container is then refilled with unused fluid.

The device of the present invention has a number of attributes that are superior over fluid dispensers in the prior art. For example, the device of the present invention provides, for the first time, a wearable container for storing and dispensing fluids that uses a removable and movable dispensing component that serves as: (i) an internal seal that prevents and/or slows backflow of the fluid within the container; (ii) a dispensing mechanism for moving the fluid through the container and expelling it from the container; (iii) a volume indicator for visualizing the amount of fluid remaining in the container; and (iv) a configuration that provides a movable dispensing component that can be removed from the container to allow for efficient filling and/or refilling of the container with replacement fluids that can then be stored and dispensed from the container.

Further, in one aspect, the present invention provides a device that is a container and dispensing device for viscous fluids that is configured to be worn comfortably on the body. Other attributes of the device of the present invention include, without limitation: (i) convenience, in that it is fillable, refillable, washable, wearable, and durable; (ii) comfort, in that it is soft to the touch and does not pinch or catch arm hair; (iii) versatile/fashionable, in that it can be configured into a discreet shape and size, have a choice of color and style for various uses (e.g., work or leisure), and be worn on the wrist or attached to an object.

As noted, the present invention provides a wearable device that can function as a convenient and portable container for storing and dispensing a variety of fluids (e.g., sunscreen, insect repellent, and hand sanitizer). These attributes are particularly useful for enabling the proper application of sunscreen. Therefore, in one aspect, the present invention is useful in addressing one of the major challenges that dermatologists face in the fight against skin cancers, namely, the failure of people to apply sun protection products when they need to. One way to address this problem is to provide a convenient means to carry and apply sunscreen (i.e., by providing the device of the present invention), and therefore influence consumer behavior in favor of the appropriate and timely application of sunscreen.

These, and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating the present invention, there are depicted in the drawings certain embodiments of the invention. However, the invention is not limited to the precise arrangements and instrumentalities of the embodiments depicted in the drawings.

FIG. 3A shows the device in an open and fillable position, with movable dispensing component 10 disposed outside of elongated container 1. FIGS. 3B-3D show the device with movable dispensing component 10 located at various stages within the elongated container.

FIG. 13A shows the device having one external manipulation ring 15. FIG. 13B shows the device having two external manipulation rings 15.

As shown in FIG. 19A, in one embodiment, elongated container 1 includes one embellishment 100. As shown in FIG. 19B, in another embodiment, elongated container 1 includes more than one embellishment 100.

DETAILED DESCRIPTION OF THE INVENTION

Figure 1:
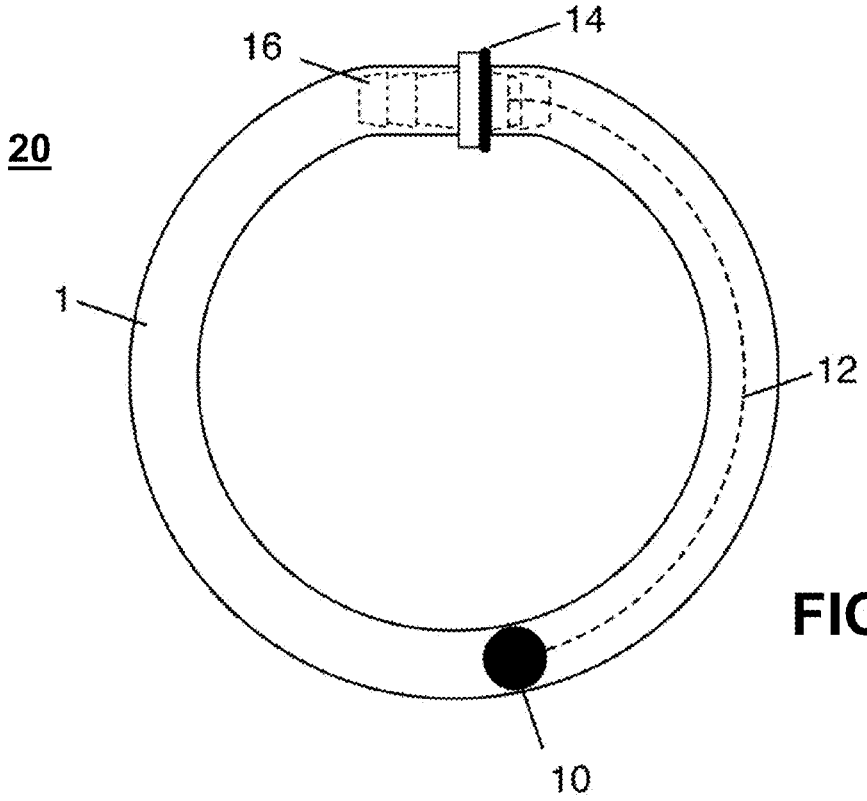
FIG. 1 is a schematic drawing of one embodiment of the device of the present invention. The device is shown in a storage position.

The present invention generally relates to a device that is effective for storing and dispensing fluids, where the device uses a movable dispensing component for manipulating the movement of fluids within and from the device. The use of the movable dispensing component enables, inter alia, a fluid to be stored in, expelled from, and refilled into the device.

The device of the present invention is suitable for storing and dispensing any fluid, i.e., any flowable material. Suitable examples of such fluids include, but are not limited to, water, beverages (e.g., juices, sodas, alcoholic beverages, sports drinks, etc.), water mixtures, sunblock, sunscreen, after-sun-care, lotions, topicals, moisturizer, sanitizer, insect repellent, personal lubricant, hand soap, body soap, shaving cream, shampoo, hair conditioner, toothpaste, cosmetics and perfumes, essential oils, body oils, pharmaceutical mixtures, nutritional mixtures, edible fluid mixtures, energy gels, body camouflage, body paint, face paint, artistic paints, glues, and the like. In a particular embodiment, the device is suitable for storing and dispensing any fluid having a viscosity about equal to or greater than the viscosity of water (measured at room temperature).

The device includes an elongated container, an outlet component, and a movable dispensing component.

The elongated container includes a hollow body having a first end and a second end. In one embodiment, the first and second ends of the container are configured to allow for their direct or indirect connection, so that when the first and second ends are connected, the elongated container is in the form of a closed ring-like structure effective for storing the fluid. In one embodiment, the elongated container is contemplated to be such that it is flexible so as to form a closed ring-like structure when the first and second ends are directly or indirectly connected. The elongated container is also contemplated to be suitable to allow for a movable dispensing component to be disposed within the elongated container and create a seal for maintaining fluid in one portion of the elongated container. The elongated container is also contemplated to be suitable to allow for a movable dispensing component to be disposed within the elongated container and also manipulated to different positions within the elongated container (e.g., to enable dispensing of a fluid from the elongated container).

In another embodiment, the elongated container is non-flexible (e.g., rigid), in which case the elongated container may be pre-formed in a suitable form that is readily useable (e.g., a bracelet, necklace, etc.). In these embodiments, the movable dispensing component can be combined with an external manipulation component, whereby the external manipulation component is disposed outside of the elongated container and used as a proxy to move the movable dispensing component inside of the elongated container.

Therefore, suitable materials for use in making the elongated container can include any material that provides an elongated container as contemplated herein. For example, suitable materials for use as the elongated container can include, without limitation, materials such as: latex, silicone, plastic, rubber, copolymers (e.g., thermoplastic elastomers, thermoplastic rubbers), neoprene, metal, metallic tubing, fabric, paper, wood, and the like. Other suitable materials for use as the elongated container can include various types of tubing made out of materials that include, but are not limited to, the following (some of which may overlap with other types or categories of materials described herein): nylon, polyurethane, polyethylene, PVC, fluoroelastomer (Viton), EPDM synthetic rubber, synthetic polyisoprene, thermoplastic rubber, nitrile, styrene butadiene (SBR), hypalon synthetic rubber, thermoplastic rubber, fabric tubing, paper tubing, wood tubing, and the like.

Suitable latex materials for use in the present invention can be obtained from various commercial sources, including, for example, from Kent Elastomer Products, Inc. (Kent, Ohio) and SML, Inc. (Akron, Ohio). Suitable silicone materials for use in the present invention can be obtained from various commercial sources, including, for example, from Allness Silicone Company, Inc. (Ontario, Canada). However, any materials suitable in forming a closed ring-like structure are contemplated by the present invention. An example of a particular type of elastomer can include, without limitation, the K-4500 product provided by Kent Elastomer Products, Inc. (Kent, Ohio) (www.kentelastomer.com). More particularly, the elongated container can be a portion of latex or silicone tubing of various diameters and lengths. For example, in one embodiment of a device of the present invention suitable for use as a bracelet, a suitable diameter of the elongated container can be around ¼ inch; a suitable wall can be about 1/16 or 3/23 inch thick. The length of the elongated container can be any length that corresponds with the intended use. For example, the length of the elongated container will vary depending on whether the device is intended to be worn around the neck, wrist, ankle, etc. In an illustrative example, a device of the present invention in the form of a bracelet can include an elongated container having a length that ranges from about 5 to about 11 inches, but need not be limited to these lengths. In another illustrative example, a device of the present invention in the form of a choker or necklace can include an elongated container having a length that ranges from about 14 to about 40 inches, but need not be limited to these lengths. One of ordinary skill in the art can readily determine the appropriate length of elongated container suitable for a particular use.

Latex and silicone have been found to provide a very good seal with consumer product bottles on the market. Further, latex and silicone are both comfortable to wear and do not pinch skin or arm hair while worn. In addition, both latex and silicone come in a large variety of color options. Latex is minimally porous and allows the scent of fluid to permeate the elongated container (e.g., the bracelet). Silicone comes in a non-opaque tubing option that minimizes product learning curve for customer.

The outlet component is directly or indirectly attached to the first end of the elongated container. The outlet component is effective as a conduit for dispensing the fluid from the elongated container. The movable dispensing component is effective for manipulating the fluid through the elongated container and for dispensing the fluid from the outlet component. The movable dispensing component is configured to be movably disposed within the container.

In one embodiment, the outlet component can include a hollow tube having a base end and a dispenser end, where the base end of the outlet component is directly or indirectly attached to the first end of the elongated container. In a particular embodiment, the outlet component is configured so that its dispenser end is tapered, barbed, or tapered and barbed. In another embodiment, the outlet component is configured so that both the dispenser end and the base end are tapered, barbed, or tapered and barbed. In yet another embodiment, a connector component is attached to the second end of the elongated container. In a particular embodiment, the outlet component can be a ¼ inch barbed nozzle with spliced coupling (Watts (North Andover, Mass.)). In another particular embodiment, the outlet component can be a rollerball plug. Suitable rollerball plugs for use in the present invention can be obtained from various commercial sources, including, for example, from Canton Fair Trading Company, Guangzhou, China. In another particular embodiment, the dispenser end of the outlet component can have a sufficient number of barbs (e.g., 3 barbs) to provide a sufficient closure connection so that the elongated container (e.g., in the form of a bracelet) does not open by itself, while the base end of the outlet component can have a sufficient number of barbs (e.g., 2 barbs) to provide an object to tether the movable dispensing component to and secure the outlet component to the cavity while maintaining a desired circular wristband shape. The outlet component can be made of such materials as plastic and metal. One of ordinary skill in the art can readily determine various outlet component configurations for use in the present invention.

A suitable connector component can be a connector that is configured to couple the second end of the elongated container to the outlet component. In one embodiment, the outlet component can include a male end and the connector component can include a corresponding female end. In an additional embodiment, the female end can include a thumb latch mechanism to hold or release the male end. Suitable thumb latch mechanisms for use in the present invention can be obtained from various commercial sources, including, for example, from US Plastic Corp. (Lima, Ohio). In another embodiment, the outlet component can include a female end and the connector component can include a corresponding male end.

In another embodiment, the dispenser end of the outlet component is configured to connect to the second end of the elongated container so that the elongated container forms a closed ring-like structure. In a particular embodiment, the outlet component and the connector component are configured to couple with one another using a screw-threading mechanism. In another embodiment, the outlet component and the connector component are configured to couple with one another using a snap-together mechanism. In another embodiment, the outlet component and the connector component are configured to couple with one another using a ball and socket mechanism. In another embodiment, the outlet component and the connector component are configured to couple with one another using a magnetic closure mechanism.

In one embodiment, the base end of the outlet component is attached to the first end of the elongated container by a binding component. A suitable binding component can include, without limitation, any band, including, for example, an O-ring, an identification band, a grommet, and the like. In a particular embodiment, the O-ring is a #7 O-ring. Suitable O-rings for use in the present invention can be obtained from various commercial sources, including, for example, from Danco, Inc. (Boothwyn, Pa.). Suitable materials for the binding component include but are not limited to, rubber, silicone, plastic, metal, and the like.

A suitable outlet component can include a dispenser end that is configured to expel the fluid therefrom and in some cases may have an internal check valve. Suitable internal check valves for use in the present invention can be obtained from various commercial sources, including, for example, from US Plastic Corp (Lima, Ohio).

As described herein, the movable dispensing component is configured to be movably disposed within the container. When the movable dispensing component is movably disposed within the container, it is effective to create a fluid partition of the container and a vacant partition of the container. The fluid partition is the portion of the container's hollow body that is terminally defined by the first end of the container and the movable dispensing component. The vacant partition is the portion of the container's hollow body that is terminally defined by the second end of the container and the movable dispensing component. The movable dispensing component is effective to prevent and/or slow the flow (particular the backflow) of fluid in certain directions within the elongated container. Whether the movable dispensing component prevents or slows backflow of the fluid will depend on the viscosity of the fluid. For example, the movable dispensing component can be effective in slowing backflow of fluids with low viscosity (e.g., water), and can be effective in preventing backflow of fluids with high viscosity (e.g., thick lotions, toothpaste).

In one embodiment, the movable dispensing component is adapted for manipulating the fluid through the container and expelling the fluid from the container through the outlet component. In another embodiment, the movable dispensing component can be a substantially solid structure, and have a shape effective (i) to create the fluid and vacant partitions of the container and (ii) for manipulating the movable dispensing component through the container so as to move the fluid through the container. A suitable movable dispensing component can contain a pore that extends through the center of its substantially solid structure. The pore of the movable dispensing component can be used to facilitate tethering of the movable dispensing component to a filament, as described herein.

Suitable movable dispensing components can be of the following exemplary shapes: spherical, round, oblong, oval, teardrop, conical, rondelle, irregular, and the like. However, any shape that enables the movable dispensing component to move within the elongated container and prevent or slow the backflow of fluid in the elongated container (e.g., fluid from moving away from the outlet component end) is contemplated by the present invention. The movable dispensing component can also be made of a material such as glass, plastic, rubber, stone, bone, horn, ivory, metal, shell, pearl, coral, gemstones, polymer clay, metal clay, resin, synthetic minerals, wood, ceramic, and fiber. In one embodiment, the movable dispensing component is a bead. With regard to dimensions, the suitable dimension of the movable dispensing component will vary depending on the inner dimension of the elongated container, so as to allow the movable dispensing component to maintain a seal within the container while still allowing for the manipulation of the movable dispensing component within the container. Suitable beads for use as movable dispensing components in the present invention can be obtained from various commercial sources, including, for example, from Beads-In-Bulk (Marietta, Ga.). In a particular embodiment, a suitable movable dispensing component can be a 6-8 mm sphere (e.g., a bead).

A filament can be used to directly or indirectly anchor the movable dispensing component to the elongated container, where the filament has a first terminal end and a second terminal end. In a particular embodiment, the first terminal end of the filament is attached to the base end of the outlet component and the second terminal end of the filament is attached to the movable dispensing component. The filament can have a length so as to allow the movable dispensing component to be exported from the second end of the elongated container while still being anchored to the elongated container. Such a configuration facilitates refilling of the elongated container with unused fluid. In a particular embodiment, the filament can be about 10 inches in length, where the elongated container is about 8.5 inches in length.

Suitable filaments for use in the device can include, without limitation, single filaments and/or multifilaments. Thus, as used herein, filament refers to any single or multi-strand material that is suitable for tethering the movable dispensing component to the elongated container, either directly or indirectly. For example, suitable filaments can include single and/or multifilament jewelry wire, artistic wire, fishing line, and the like. Examples of jewelry wire include, without limitation, jewelry wire made of or coated with a material selected from the group consisting of silver, gold, copper, brass, nickel, zinc, tin, tungsten, and the like. Suitable fishing line can include, without limitation, braided multi-filament fishing line. Other suitable filaments can be made from a material selected from the group consisting of linen twine, hemp twine, Kevlar, silk, nylon, elastic, imitation silk, monofilament, Nymo, silamide, coated wire (e.g., Beadalon, Valley Twp., Pa.), tiger tail, and the like.

As described herein, the device of the present invention, when in the form of a closed ring-like structure, can be worn as a bracelet on the wrist of an individual, as an anklet on the ankle of an individual, as a necklace around the neck of an individual, as a removable attachment to an inanimate object, and the like. Examples of inanimate objects contemplated by the present invention include, for example, a bike, a backpack, a garment, a purse, a bag, a belt loop, and the like. The device of the present invention can also be used in various other types of body accessories and clothing or accessory attachments, including, without limitation, as a bangle, armlet, pendant, waistband/belt, keychain, carabiner, and the like.

The device of the present invention can further include one or more embellishment selected from the group consisting of charms, stones, gems, ornaments, precious metals, and the like.

The device of the present invention can also include one or more external manipulation rings configured to facilitate manipulation of the movable dispensing component within the elongated container. The external manipulation rings can be made of any material that will substantially maintain a ring-like structure, includes materials such as metals, rubbers, plastics, and the like. The external manipulation rings are configured to fit around the exterior of the elongated container and to have a diameter that is less than that of the movable dispensing component.

The present invention also relates to a kit that includes the device of the present invention and a filling attachment. The filling attachment includes an attachment end and an adapter end. The attachment end is configured to insert a fluid into the elongated container. The adapter end is configured to connect to a reservoir containing the fluid prior to the fluid being inserted into the elongated container. Suitable filling attachments can include, for example, a suction cup bottle connector, a twist-on bottle connector, a snap on bottle connector, a flexible funnel, a barbed funnel and a rubber ring bottle connector. A suitable reservoir can be any vessel that can hold unused fluid, including, for example, a bottle, a tube, a packet, and the like. The kit can further include one or more embellishment selected from the group consisting of charms, stones, gems, ornaments, precious metals, and the like.

In yet another aspect, the present invention relates to a kit that includes a compilation of component parts comprising the elongated container, the outlet component, and the movable dispensing component of the device of the present invention. The kit can further include a filament for directly or indirectly anchoring the movable dispensing component to the elongated container. The kit can also include a filling attachment comprising a attachment end and an adapter end. The attachment end is configured to insert a fluid into the elongated container. The adapter end is configured to connect to a reservoir containing the fluid prior to the fluid being inserted into the elongated container. The kit can further include one or more embellishment selected from the group consisting of charms, stones, gems, ornaments, precious metals, and the like.

In another aspect, the present invention relates to a method for storing a fluid. This method involves providing a device of the present invention. The device contains the fluid and is provided so that the first end and second end of the elongated container of the device are connected so as to form a closed ring-like structure, thereby storing the fluid.

In still another aspect, the present invention relates to a method for dispensing a fluid. This method involves providing a device of the present invention. The device contains the fluid and is provided so that the first end and second end of the elongated container are not connected. Thereafter, the movable dispensing component is manipulated in a direction toward the first end of the elongated container so that the fluid is expelled from the outlet component.

In yet another aspect, the present invention relates to a method for storing, dispensing, and refilling a fluid. This method involves providing a device of the present invention. The device contains the fluid and is provided so that the first end and second end of the elongated container are connected so as to form a closed ring-like structure, thereby storing the fluid. Thereafter, the first end and second end of the elongated container are disconnected. The movable dispensing component is then manipulated in a direction toward the first end of the elongated container so that the fluid is expelled from the outlet component. The elongated container is then refilled with unused fluid.

In one embodiment, the refilling step can include removing the movable dispensing component from within the elongated container, and inserting unused fluid through the second end of the elongated container.

In another embodiment, the refilling step can include maintaining the movable dispensing component at a position within the elongated container, and inserting unused fluid through the first end of the elongated container.

Turning to the Figures, various embodiments of the present invention are further described herein below.

In one embodiment (see, e.g., FIGS. 1-3), device 20 of the present invention is a wearable container for carrying and dispensing a fluid 30. Device 20 includes an elongated container 1 structured such that both ends are open and therefore allow for the filling, dispensing, rinsing, and refilling of fluid 30 by a user. One end of container 1 can be connected to outlet component 16 (e.g., a tapered nozzle) that facilitates dispensing and tightly connects to the opposite end of container 1 to form a circular ring-like shape. Inside container 1 can be movable dispensing component 10 (e.g., a sphere) that is tethered to outlet component 16 (e.g., a nozzle) by filament 12. Movable dispensing component 10 acts as a plug to prevent or slow fluid 30 from spilling from the end opposite to the end connected to outlet component 16. Movable dispensing component 10 also is a dispensing force that as it is moved through container 1 pushes fluid 30 (e.g., a viscous liquid) (see FIG. 3) out of outlet component 16 (e.g, a nozzle). Additionally, movable dispensing component 10 (e.g, in the form of a sphere) can be used to indicate (e.g., visually or by touch) how much fluid remains inside container 1. Container 1 (e.g, including a tubular cavity) is made of a flexible and squeezable material such as latex or silicone that can be worn comfortably around the wrist, for example, and is of a size that maintains the circular shape, and whereby more than one can easily be worn at the same time.

As shown in FIG. 1, in one embodiment, device 20 of the present invention can form a circular ring-like shape when the ends of elongated container 1 are connected. Outlet component 16 is attached to one end of elongated container 1 by binding component 14, and then is inserted into the opposing end of elongated container 1 to form a circular ring-like shape that allows for device 20 to store a suitable fluid therein. In this embodiment, movable dispensing component 10 is tethered to one end of elongated container 1 by filament 12.

Figure 2:
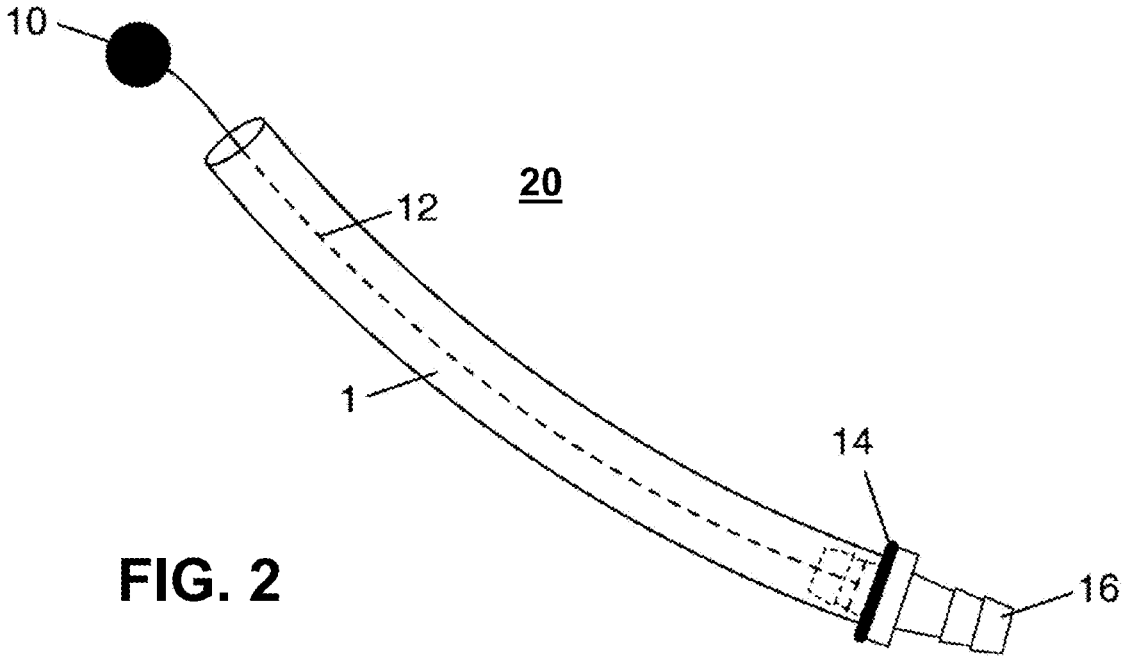
FIG. 2 is a schematic drawing of one embodiment of the device of the present invention. The device is shown in an open and fillable position.
Figures 3A, 3B, 3C, 3D:
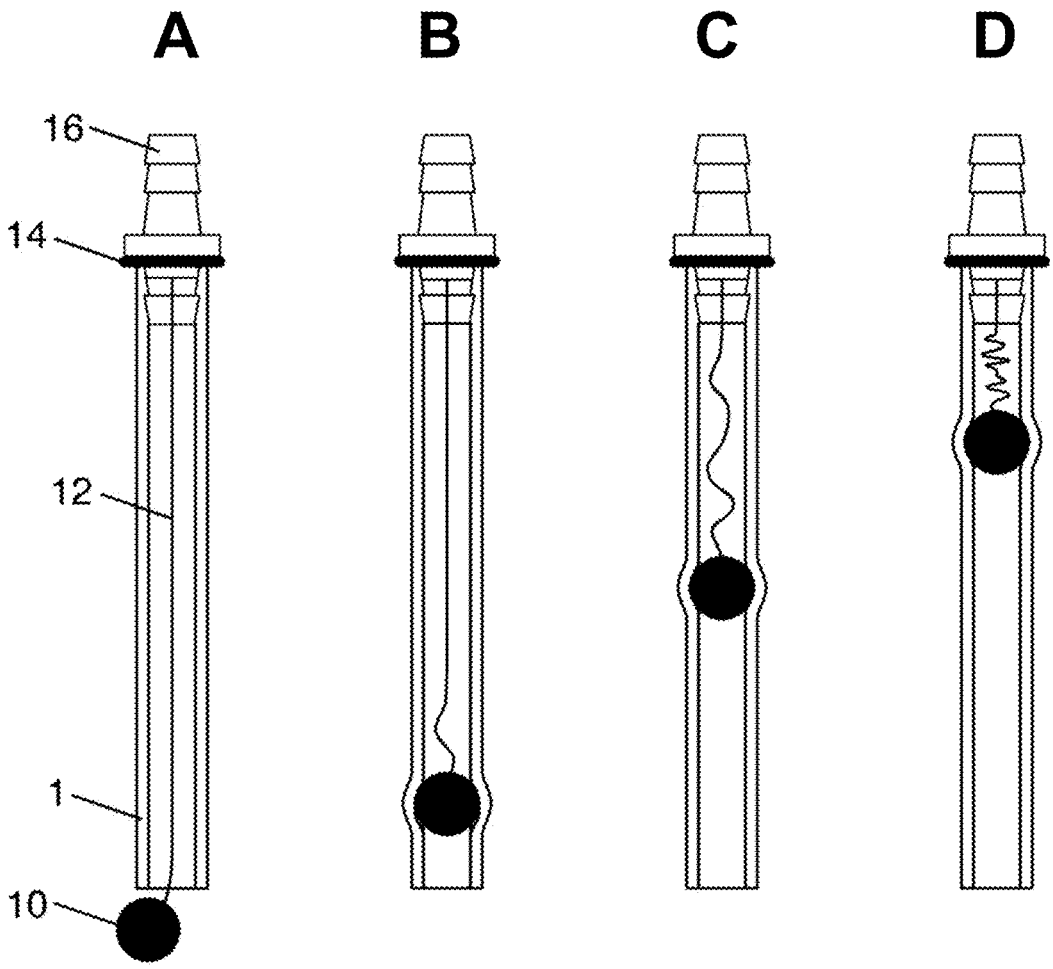
FIGS. 3A-3D are various schematic drawings of one embodiment of the device of the present invention. This embodiment is configured so that movable dispensing component 10 is tethered to the base end of outlet component 16.

As shown in FIG. 2, in one embodiment, device 20 is configured to allow for refilling of a suitable fluid into elongated container 1 by way of the end that is opposite to outlet component 16. For example, in order to refill elongated container 1 with a fluid, movable dispensing component 10 can be removed from within elongated container 1. The fluid may then be inserted through the open end of elongated container 1 until the desired fluid level is reached, and then movable dispensing component 10 can be inserted back into elongated container 1 to create a seal, as discussed herein above. In the embodiment shown in FIG. 2, movable dispensing component 10 is tethered to elongated container 1 by filament 12. However, the present invention also contemplates embodiments in which movable dispensing component 10 is not required to be tethered to elongated container 1 (see, e.g., FIG. 10, FIG. 12, and FIGS. 14A-14C).

FIGS. 3A-3D show how filament 12 slackens as movable dispensing component 10 is manipulated toward outlet component 16 as the fluid contained in elongated container 1 is dispensed from the device through outlet component 16.

Figure 4:
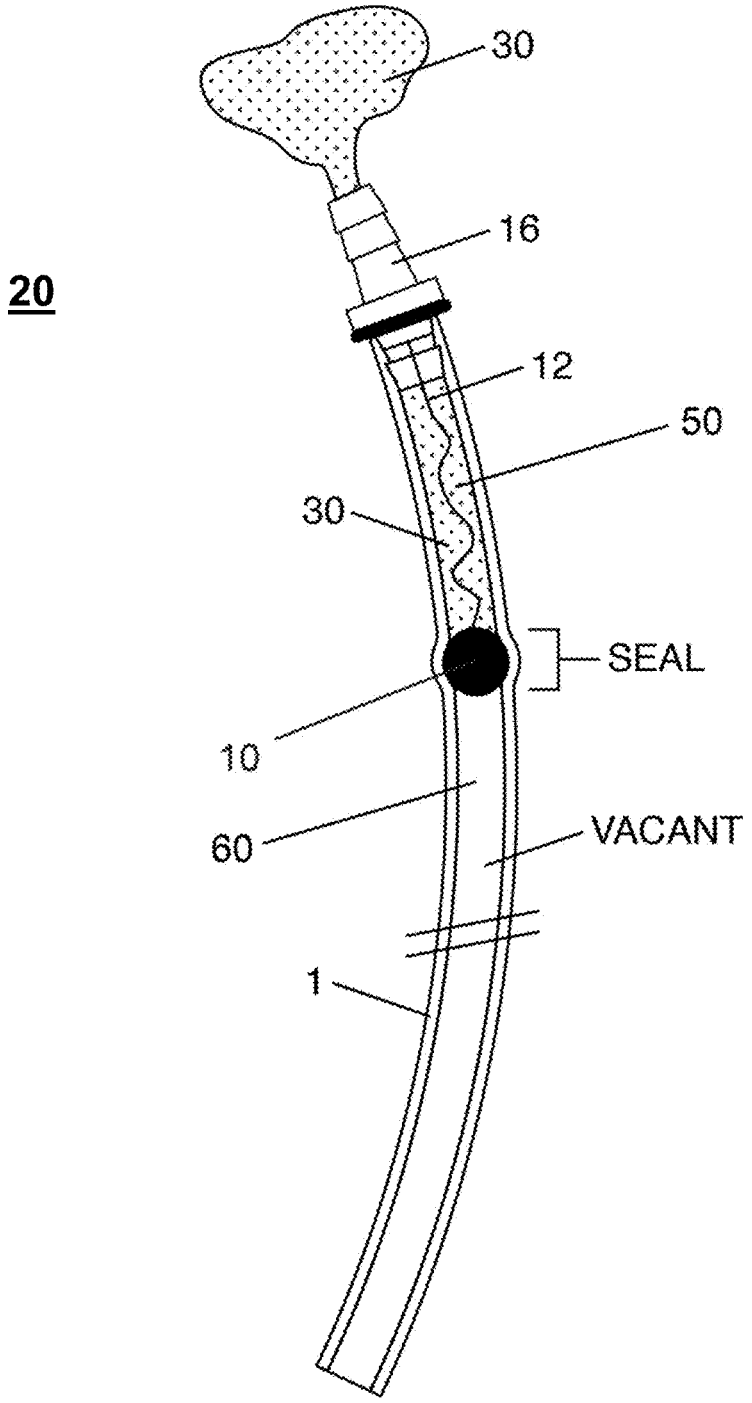
FIG. 4 is a schematic drawing of one embodiment of the device of the present invention. This figure shows elongated container 1 in an open position and at a partially filled state with a viscous fluid 30 being dispensed therefrom.

FIG. 4 provides a perspective view of one embodiment of device 20 in which elongated container 1 is in the open position for dispensing of fluid 30. Movable dispensing component 10 is shown to create a seal, and thereby to create a partition within elongated container 1, where one partition is fluid partition 50 and the other partition is vacant partition 60. As movable dispensing component 10 is manipulated toward outlet component 16, fluid 30 is dispensed from elongated container 1 through outlet component 16, as shown.

Figure 5:
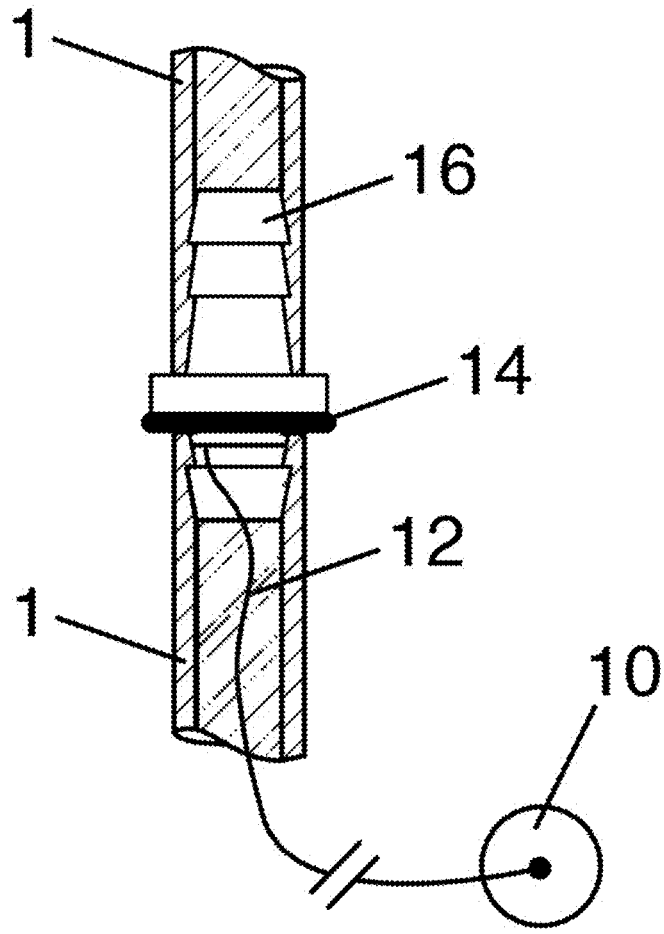
FIG. 5 is an exploded view of one embodiment of an outlet component of the device of the present invention. In this embodiment, outlet component 16 is a barbed nozzle that also serves as a connector for the first and second ends of elongated container 1. This figure shows the device in a closed position at the point of connection of the two ends of elongated container 1.

FIG. 5 shows a close-up view of the connection of the two opposing ends of elongated container 1 in one embodiment of the device of the present invention. In this embodiment, binding component 14 is an O-ring that serves to attach outlet component 16 to one end of elongated container 1. In the embodiment shown in FIG. 5, outlet component 16 is a barbed nozzle. Filament 12 is attached to elongated container 1 at the dispensing end. Movable dispensing component 10 is shown attached to filament 12.

Figure 6:
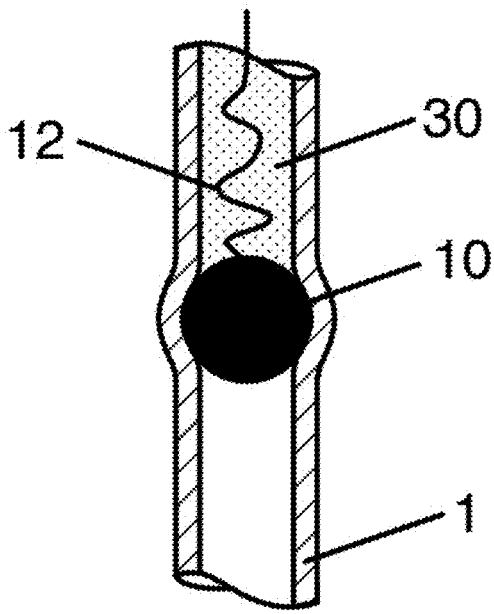
FIG. 6 is a close-up perspective view of the seal created by the movable dispensing component within the elongated container. In the embodiment shown in this figure, the movable dispensing component is a tethered sphere.

FIG. 6 is a close-up view of the seal created by movable dispensing component 10. This figure shows fluid 30 partitioned on one side of movable dispensing component 10. Filament 12 is shown attached to movable dispensing component 10 with a certain degree of slack. As shown in this embodiment, one benefit of movable dispensing component 10 is its characteristic to serve as a visual and tactile guide of the level of fluid 30 within elongated container 1. This feature can be useful in various circumstances, including in situations where the material used for elongated container 1 is opaque or where the fluid is clear or otherwise unable to be visually distinguished from the vacant portion of elongated container 1.

Figure 7A:
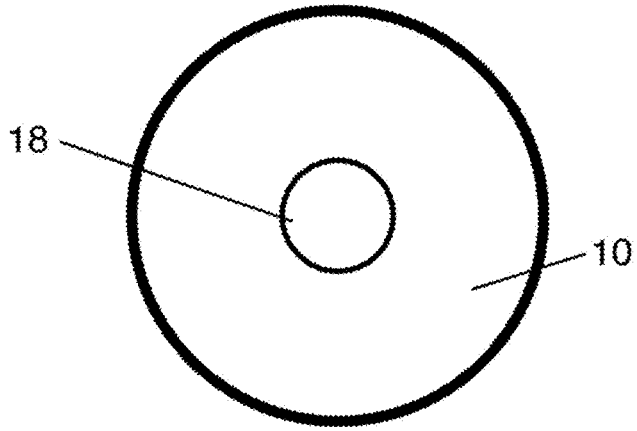
FIGS. 7A-7C are schematic drawings of various views of one embodiment of the movable dispensing component of the present invention.
Figure 7B:
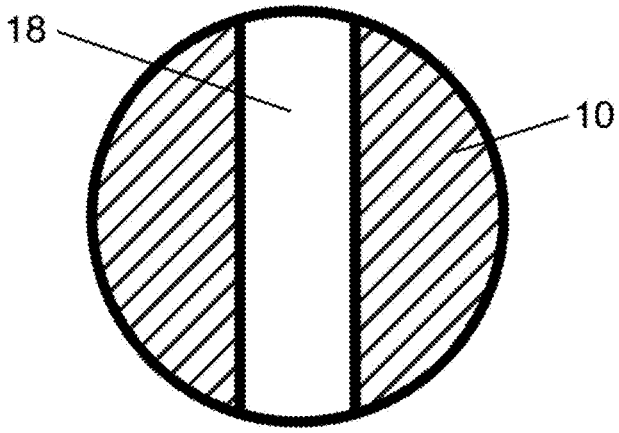
Figure 7C:
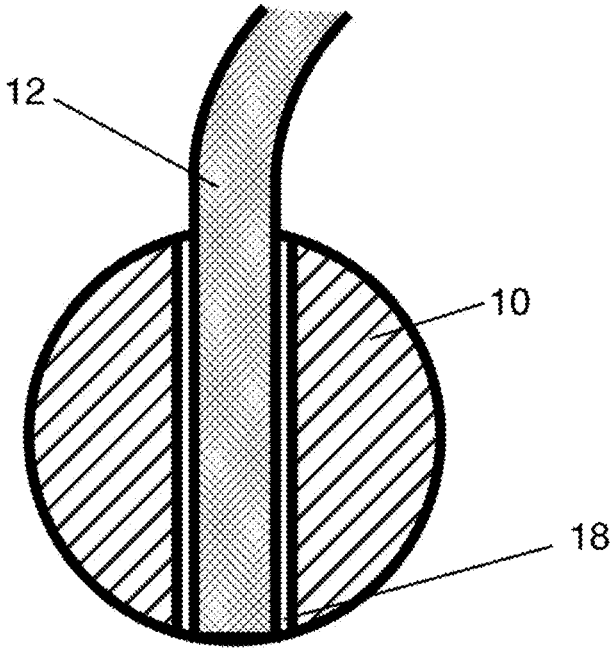

Turning to FIGS. 7A-7C, movable dispensing component 10 can be configured to include pore 18, which can be used for securing filament 12 to one end of elongated container 1. FIG. 7A is a top view of movable dispensing component 10 showing pore 18. FIGS. 7B and 7C are cross-sectional views of dispensing component 10 showing pore 18 running through dispensing component 10, with FIG. 7C also showing filament 12 inserted into pore 18.

Figures 8A, 8B, 8C, 8D, 8E:
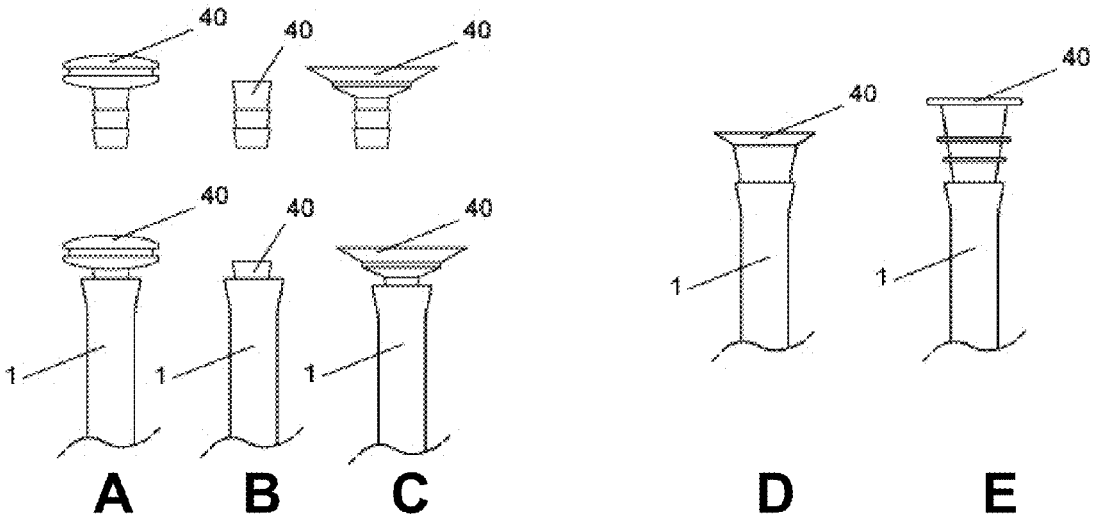
FIGS. 8A-8E are schematic drawings of embodiments of various filling attachments 40 for use in the present invention.

The device of the present invention is suitable for use with various fluids that are commercially available, regardless of the type of packaging used for the fluid. As shown in FIGS. 8A-8E, various filling attachments 40 can be used as adapters to assist in filling and refilling the device with a fluid, including fluids contained in various types of packaging (e.g., bottles). The top portion of FIGS. 8A-8C show filling attachments 40 prior to insertion into elongated container 1. The bottom portion of FIGS. 8A-8C show filling attachments 40 after they have been inserted into elongated container 1. FIGS. 8D and 8E show filling attachments 40 inserted into elongated container 1. Thus, filling attachment 40 can be used or configured to be used with the various types of standard bottle tops that are commercially available for the types of fluids suitable for the device of the present invention.

Figures 9A, 9B, 9C, 9D, 9E, 9F:
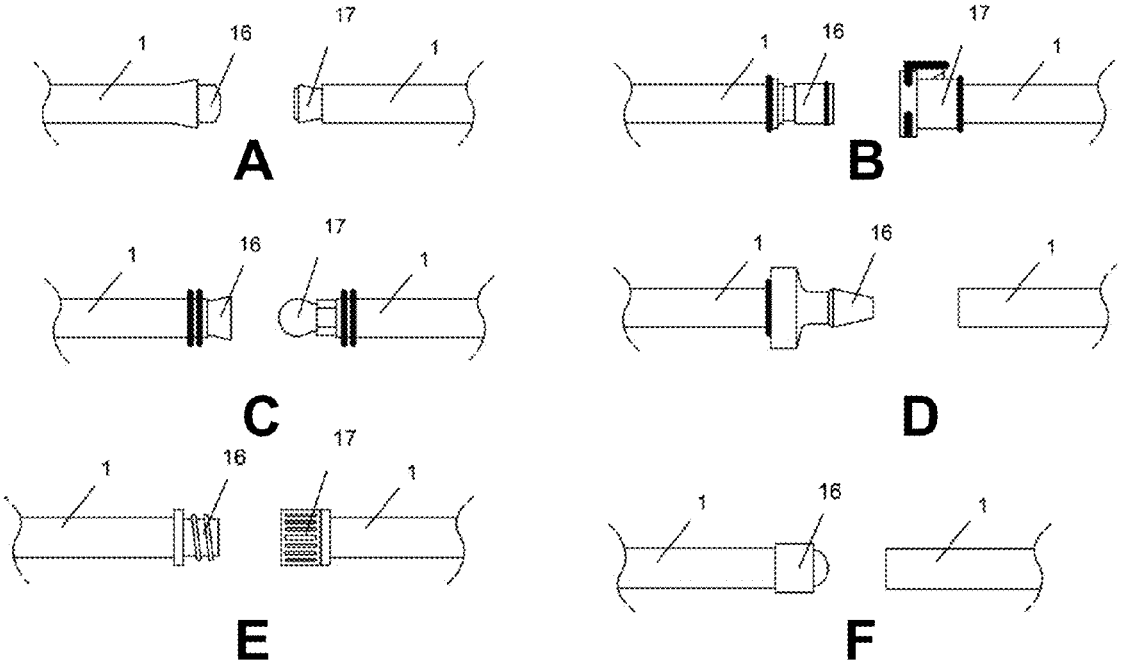
FIGS. 9A-9F are schematic drawings of embodiments of various outlet component and corresponding connector component combinations.
Figure 10:
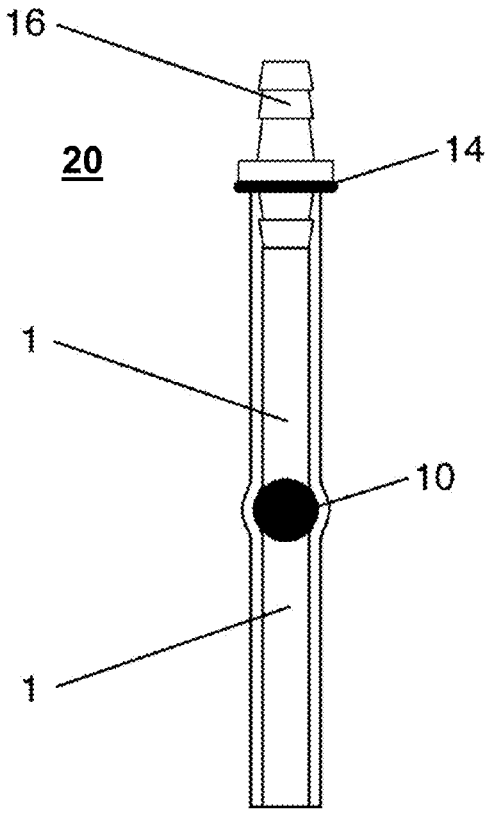
FIG. 10 is a schematic drawing of one embodiment of the device of the present invention, in which movable dispensing component 10 is not tethered to elongated container 1.

As shown in FIGS. 9A-9F, the device of the present invention can be configured to include various outlet component and corresponding connector component combinations. FIGS. 9A-9F show various types of outlet components 16 and connector components 17 prior to connection to one another. In these embodiments, device 20 can be configured to include connector component 17 that can be securely attached to outlet component 16 when in closed position, and then detached for refilling. As shown in FIG. 9A, in one embodiment, outlet component 16 and connector component 17 can be configured to be attached by way of magnetic force. FIG. 9B shows an outlet component 16/connector component 17 combination in which connector component 17 includes a thumb latch mechanism to hold or release outlet component 16. FIG. 9C shows an embodiment in which outlet component 16 and connector component 17 are configured to be snapped together. FIG. 9E shows an embodiment in which outlet component 16 and connector component 17 are configured to be screwed together. FIGS. 9D and 9F show embodiments where outlet component 16 connects to the opposing end of elongated container 1, without the need for a separate connector component 17.

The device of the present invention can be configured so that both ends of elongated container 1 are designed to serve as both dispensing and filling ports. For example, in one such embodiment, movable dispensing component 10 can be untethered (see FIG. 10), so that the fluid can be refilled in one end of elongated container 1 and dispensed through the same end thereof. Therefore, in such an embodiment, refilling and dispensing of fluid 30 would not require removing movable dispensing component 10 from within elongated container 1.

Figure 11:
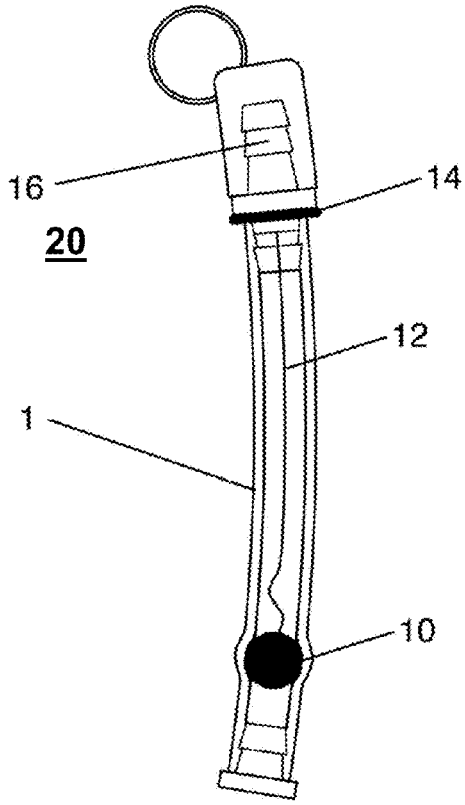
FIG. 11 is a schematic drawing of one embodiment of the device of the present invention, in which the device is configured to both store and dispense the fluid while being maintained in a linear configuration. As shown in this figure, a terminal cap is inserted at the end opposite to outlet component 16. The terminal cap can be configured to be removable in order to allow for filling and refilling of elongated container 1 with fluids.

The device of the present invention can also be configured to both store and dispense the fluid while being maintained in a linear configuration (see FIG. 11). In other words, the device would be able to store the fluid in an open position, as opposed to requiring the opposing ends of the elongated container to be attached. In such an embodiment, the ends of the elongated container are configured so that they can be sealed and opened. As illustrated in FIG. 11, in a particular configuration of this embodiment, the device of the present invention can include a keychain like attachment to allow securing of the device to a belt loop, strap, or the like.

Figure 12:
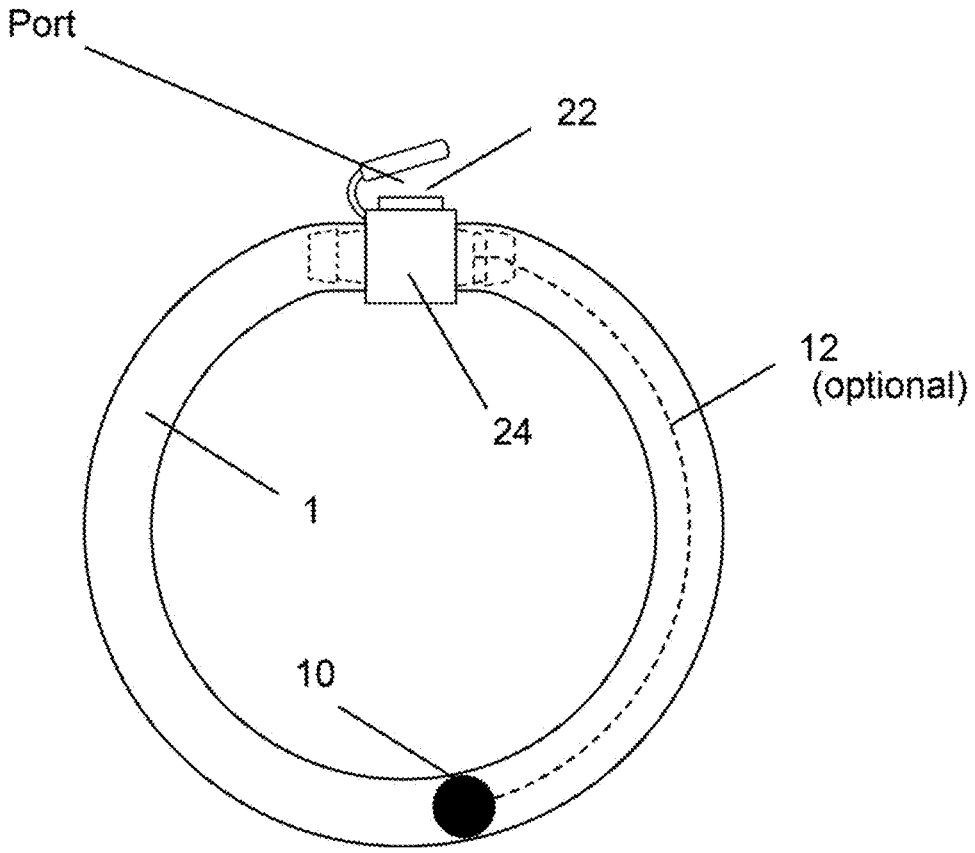
FIG. 12 is a schematic drawing of one embodiment of the device of the present invention, in which the device is configured to both store and dispense the fluid while being maintained in a closed, ring-like configuration.

The device of the present invention can also be configured to both store and dispense the fluid while being maintained in a closed, ring-like configuration (see FIG. 12). Referring to FIG. 12, in such an embodiment, the device can include outlet/connector combination 24 having port 22 and having a lid that can be opened and closed to allow for one to dispense and/or refill the fluid from elongated container 1, without requiring the ends of elongated container 1 to be detached from one another. As shown in FIG. 12, such an embodiment may optionally be configured so that movable dispensing component 10 is tethered to filament 12, although this embodiment may also be configured so that movable dispensing component 10 is not tethered to filament 12.

Figures 13A, 13B:
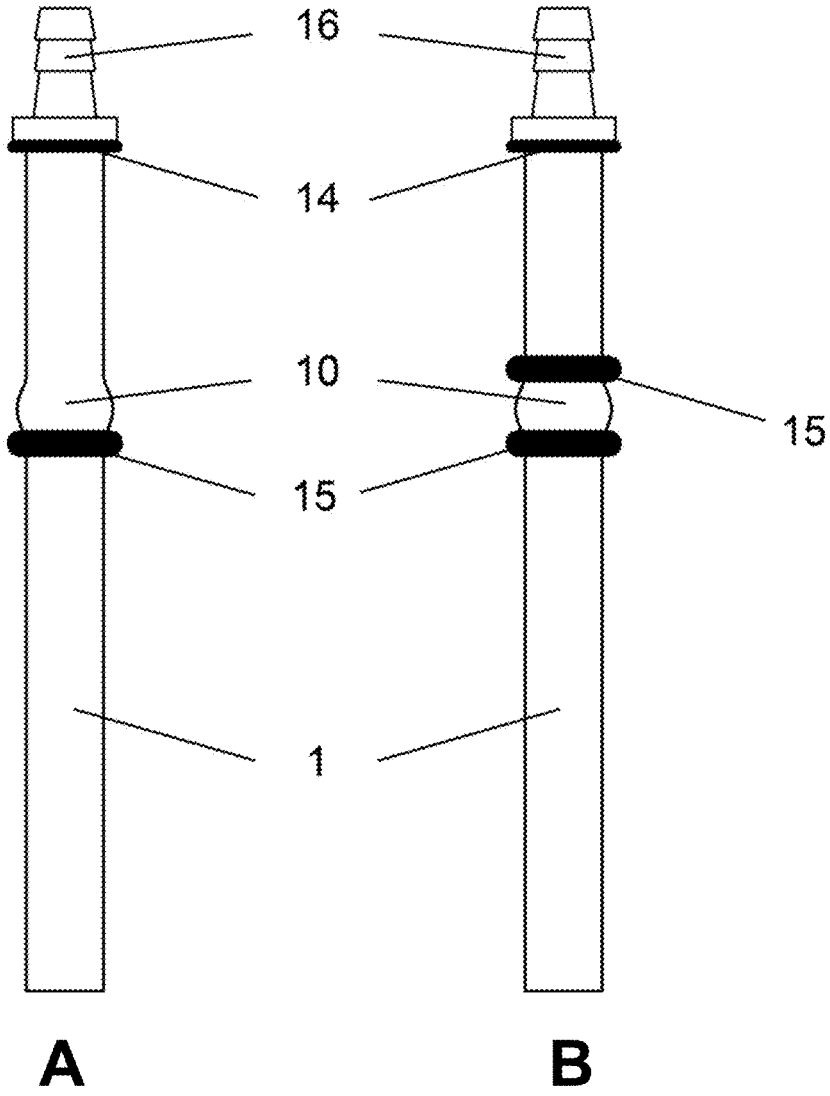
FIGS. 13A-13B are schematic drawings of one embodiment of the device of the present invention, in which the device is configured to include an external manipulation ring that can be used to facilitate manipulation of the movable dispensing component within the elongated container.

The device of the present invention can also be configured to include an external manipulation ring that can be used to facilitate manipulation of the movable dispensing component within the elongated container (see FIGS. 13A-13B). FIG. 13A shows the device having one external manipulation ring 15. FIG. 13B shows the device having two external manipulation rings 15. As shown in FIG. 13B, in one configuration of this embodiment, at least two external manipulation rings can be included, e.g., one on either side of the movable dispensing component. This configuration allows for the external manipulation rings to be used to move the movable dispensing component in both directions within the elongated container. The external manipulation rings can be constructed so that they have a diameter that is smaller than the diameter of the movable sealing ring.

Figures 14A, 14B, 14C:
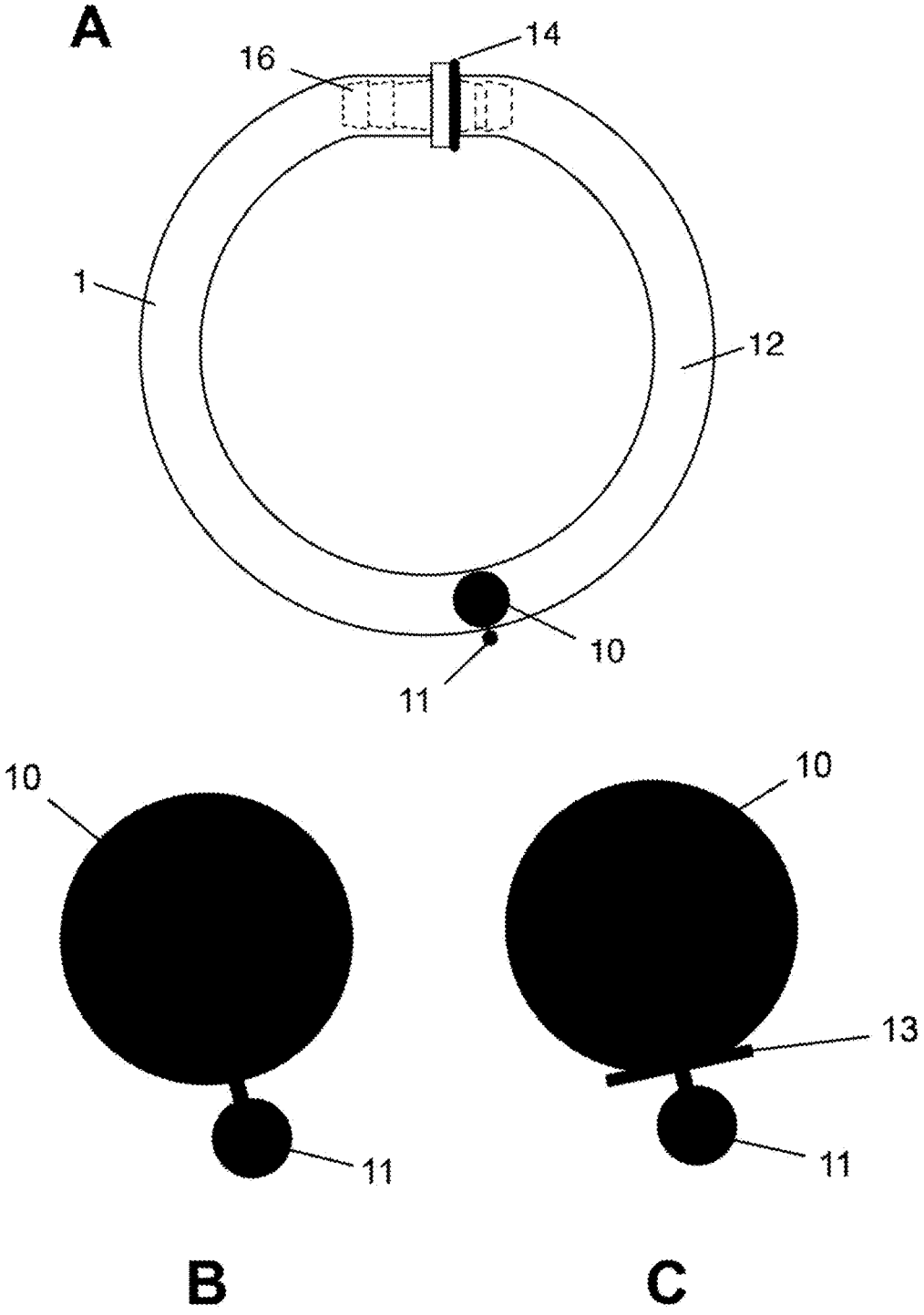
FIGS. 14A-14C are schematic drawings of one embodiment of the device of the present invention, in which the device is configured to include movable dispensing component 10 having external manipulation component 11.

As set forth herein, the device of the present invention can include an elongated container that is pre-formed and/or made of a rigid material. Examples of devices that are pre-formed or made of rigid materials can include, without limitation, devices made of wood, metal, hard plastic, and the like. Because of their rigidity, these devices generally will not be suitable for manipulation by directly pressing or pushing on the outside of the elongated container in order to move the movable dispensing component within the elongated container. Therefore, as shown in FIGS. 14A-14C, these types of embodiments of the device of the present invention can be configured to use external manipulation component 11 to assist in moving movable dispensing component 10. This embodiment also makes it unnecessary for movable dispensing component 10 to be tethered to a filament. As shown in FIG. 14A, movable dispensing component 10 is disposed inside of elongated container 1 and external manipulation component 11 is disposed outside of elongated container 1. FIGS. 14B and 14C show close-up views of movable dispensing component 10 and external manipulation component 11. FIG. 14C also shows guard 13, which serves to prevent or inhibit fluid from escaping any opening made to elongated container 1. In other such embodiments, movable dispensing component 10 and external manipulation component 11 can connect to one another by snapping or screwing mechanisms. In other embodiments, the movable dispensing component can be made of metal and the external manipulation component can be a magnetic material, or otherwise assist in moving the movable dispensing component through magnetic force as opposed to physical force.

Figures 15A, 15B, 15C, 15D:
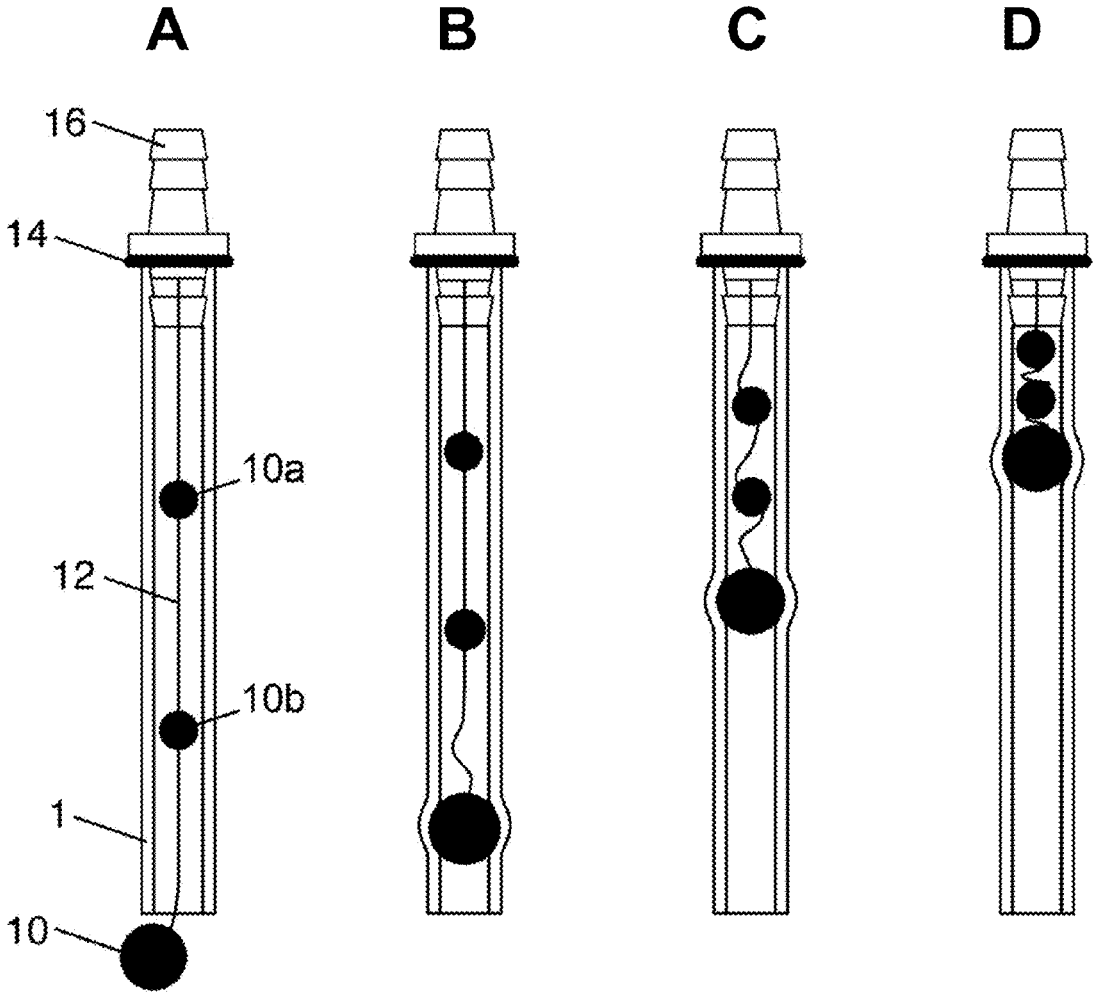
FIGS. 15A-15D are various schematic drawings of one embodiment of the device of the present invention. This embodiment is configured to include multiple movable dispensing components 10.

As set forth herein, the device of the present invention can be configured to have more than one movable dispensing component. The plurality of movable dispensing components may be tethered or not tethered, and may be of the same or different size and shape. For example, as shown in FIGS. 15A-15D, one such embodiment can include three movable dispensing components, including movable dispensing component 10, movable dispensing component 10*a*, and movable dispensing component 10*b*. In this embodiment, movable dispensing component 10 can be tethered to filament 12. As shown in FIGS. 15A-15D, movable dispensing components 10*a* and 10*b* can be smaller than movable dispensing component 10, but need not be smaller (i.e., they could be the same size or larger than movable dispensing component 10). Further, movable dispensing components 10*a* and 10*b* can be strung along filament 12 so that they can move along filament 12, or they can be secured in place along filament 12. One effective use of such an embodiment is to allow for a desired or predetermined unit of fluid to be dispensed per movement of a movable dispensing component (e.g., calibrated as amount of fluid contained between movable dispensing component 10*a* and 10*b*). As shown in FIG. 15A, in this embodiment, movable dispensing component 10 is tethered by filament 12 to the base end of outlet component 16. FIG. 15A shows the device in an open and fillable position, with the terminal movable dispensing component 10 being disposed outside of elongated container 1, and movable dispensing components 10*a* and 10*b* being disposed inside of elongated container 1. FIGS. 15B-15D show the device with all three movable dispensing components 10, 10*a*, and 10*b* located at various stages within the elongated container. Having multiple movable dispensing components assists in enhancing the dispensing functionality of the movable dispensing components, in that they can work together to manipulate flow of fluid in a desired direction within elongated container 1 and/or prevent or slow flow of fluid in an undesired direction within elongated container 1 (e.g., slow or prevent backflow of fluid).

Figure 16:
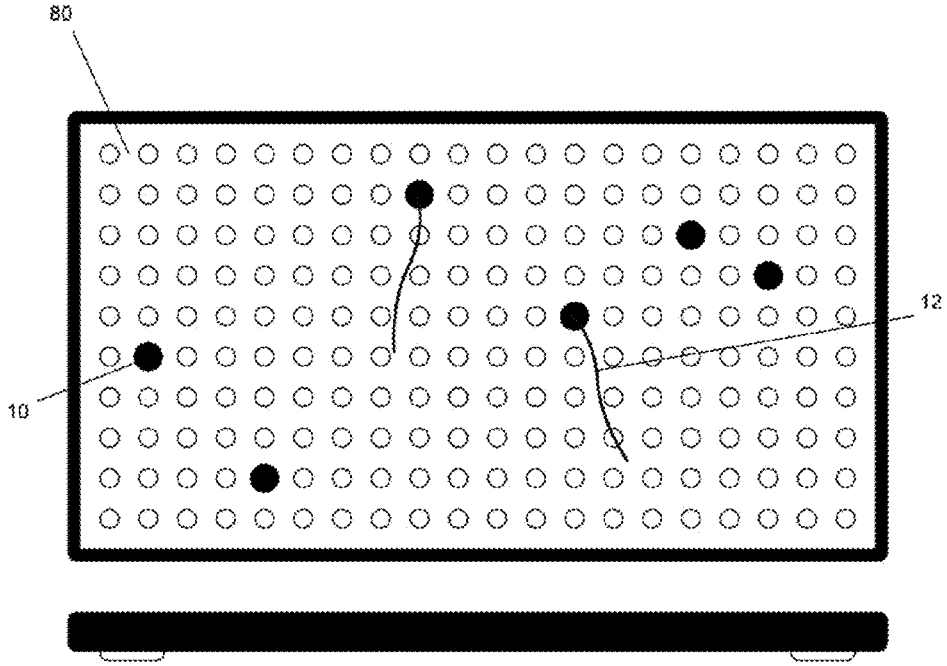
FIG. 16 is a schematic of one embodiment of a production board designed for manufacturing the device of the present invention in mass quantities. This figure shows production board 80 having a plurality of holes for holding movable dispensing component 10 in place during production. This figure shows movable dispensing components 10 prior to attachment of filament 12 and after attachment of filament 12. The top view of FIG. 16 shows a top view of production board 80, while the bottom view of FIG. 16 shows a side view of production board 80.
Figure 17:
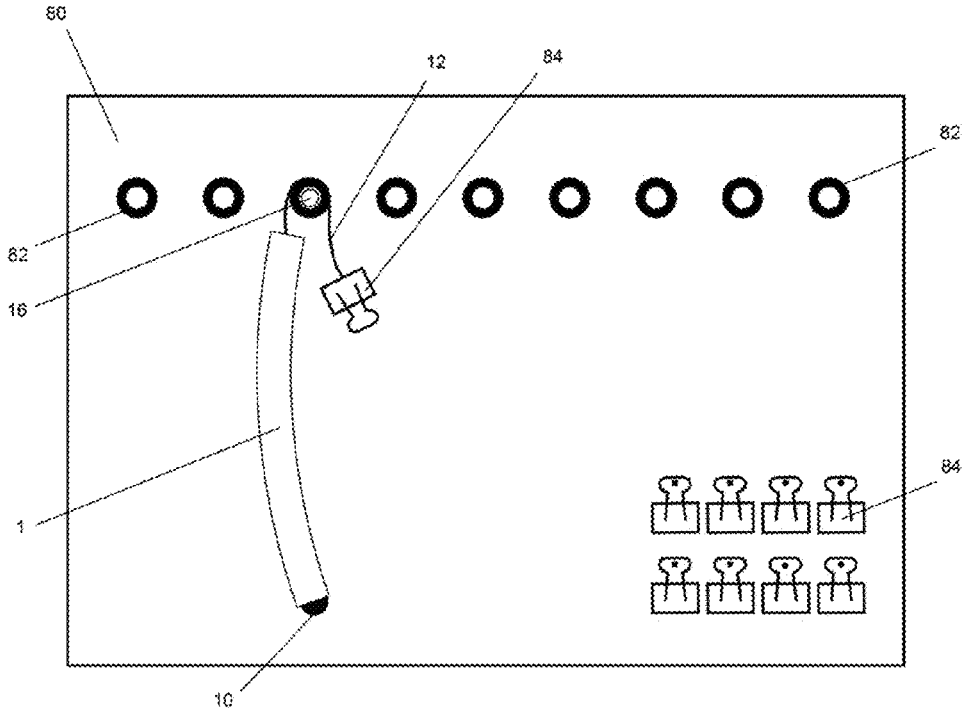
FIG. 17 is a schematic of one embodiment of a production board designed for manufacturing the device of the present invention in mass quantities, with the production board servicing as a connector board. This figure shows production board 80 (connector board 80) having grommets 82 inserted into holes of connector board 80 into which outlet component 16 can be inserted, thereby facilitating attachment of filament 12 to outlet component 16 by keeping outlet component 16 in place during production of the device. During production, clip 84 (e.g., a binder clip or other suitable weight) can be removably attached to one end of filament 12 to counterbalance the weight of elongated container 1.
Figure 18A:
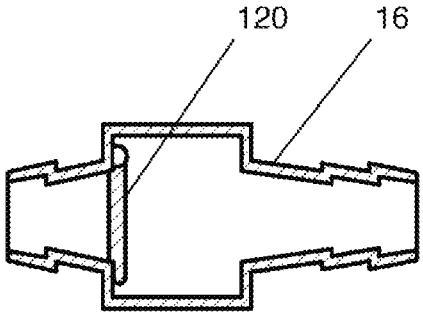
FIGS. 18A-18B are schematic drawings of various embodiments of outlet component 16 of the device of the present invention. In these embodiments, outlet component 16 includes internal check valve 120.
Figure 18B:
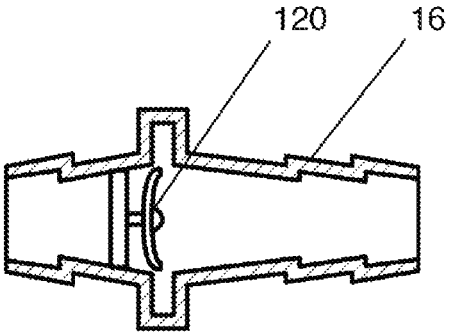
Figure 19A:
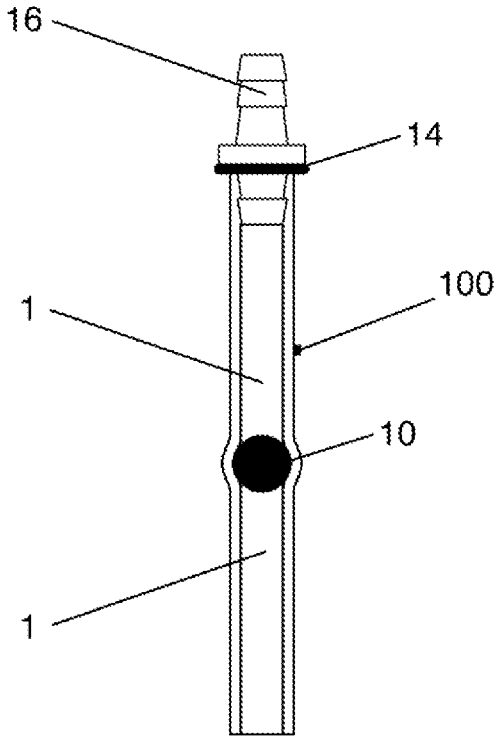
FIGS. 19A-19B are schematic drawings of various embodiments of the device of the present invention. In these embodiments, the device further comprises one or more embellishment 100.
Figure 19B:
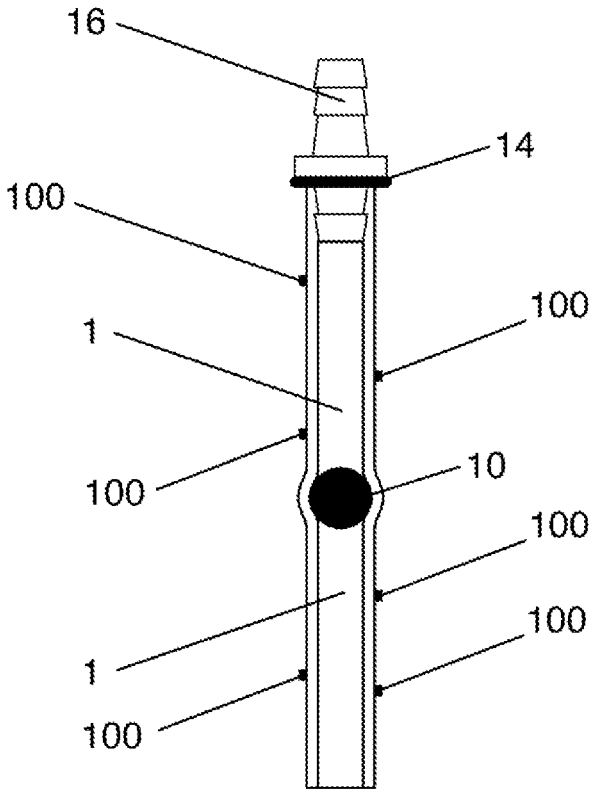

FIGS. 16 and 17 illustrate production boards and connector boards designed for manufacturing the device in mass quantities. As shown in FIG. 16, movable dispensing component 10 can lay flat on production board 80 (e.g., a Bead Board having many holes) into which multiple movable dispensing components 10 can be placed. The production board is configured to have holes that are smaller than movable dispensing component 10 and therefore provides a stationary surface to rest before and after filaments 12 are attached. As shown in FIG. 17, production board 80 is configured as a connector board that is an upright board with grommeted holes having grommets 82 into which outlet components 16 are placed. This placement provides a stationary surface to adhere filaments 12 to outlet components 16.

The device can be manufactured as described below. The order of the steps can be changed according to methods well known by those of ordinary skill in the art. Filament 12 is attached to movable dispensing component 10. Filament 12 is fed through the internal portion of elongated container 1. Binding component 14 (e.g., an O-ring) is disposed around the first end of elongated container 1. One terminal end of filament 12 (i.e., the end not attached to movable dispensing component 10) is adhered to the base end of outlet component 16 (e.g., a nozzle). Outlet component 16 is then inserted into and adhered to the first end of elongated container 1. Binding component 14 (e.g., an O-ring) is adhered to container 1 and outlet component 16.

Manufacturing the device in greater quantities can be achieved by incorporating the production (FIG. 16) and connector (FIG. 17) boards specifically designed for device production into these steps. In one embodiment, producing more than one device of the present invention can include three subassembly procedures, as described below.

Subassembly Procedure No. 1:

Tether the bead. Cut tethers (e.g., 15 inches each). Lay out 60 beads on the bead board, 2 spaces apart, with holes facing up. Place 1 drop of glue in each bead hole. Insert a tether in each bead hole until it is almost sticking out the other end of the hole; let dry/cure.

Subassembly Procedure No. 2:

Tether connector. Insert connector(s) in connector board 2-barbed side sticking out. Take 1 tethered bead and feed tether through tubing. Add an O-ring over the excess tether and just onto/around the tubing. Take excess tether and tie 1-2 knots around 2-barbed end. Add a clip to the excess tether to hold it in place. Add 1 drop of glue to knot and let dry/cure. Trim excess tether as close to connector as possible.

Subassembly Procedure No. 3:

Final Bracelet Assembly. Put 1 drop of glue on 2-barbed end of connector, spread once around, then insert connector in tube. Put/glue O-ring in place adjacent to connector. Put Bead back inside tube approx ½ inch. Close bracelet.

EXAMPLES

The following examples are intended to illustrate particular embodiments of the present invention, but are by no means intended to limit the scope of the present invention.

Example 1

Bracelet for Storing and Dispensing Fluid

A device for storing and dispensing fluid was made in the form of a bracelet. The following components were used: an elongated container 1 made of silver colored latex tubing nine inches in length, with an inside diameter of ¼ inch and a wall of 3/32 inch; a filament 12 made of 6 lb. clear artists wire; a movable dispensing component 10 in the form of a 7 mm red glass bead; a binding component 17 comprised of a #7 black o-ring; an outlet component 16 made of a ¼ inch nylon barbed coupling.

The following steps were used to construct the bracelet: Filament 12, 6 lb. clear artists wire, is glued to movable dispensing component 10, 7 mm red glass bead. Filament 12, 6 lb. clear artists wire, is then fed through the internal portion of elongated container 1, silver colored latex tubing. Binding component 14, #7 black o-ring is disposed around the first end of elongated container 1, silver colored latex tubing. One terminal end of filament 12, 6 lb. clear artists wire (i.e., the end not attached to movable dispensing component 10, 7 mm red glass bead) is wrapped around and glued to the base end of outlet component 16, ¼ inch nylon barbed coupling. Outlet component 16, ¼ inch nylon barbed coupling is then inserted into and adhered to the first end of elongated container 1, silver colored latex tubing. Binding component 14, #7 black o-ring is then moved adjacent to outlet component 16, ¼ inch nylon barbed coupling and glued in place. The movable dispensing component 10, 7 mm red glass bead, is now internally tethered to the outlet component 16, ¼ inch nylon barbed coupling by filament 12, clear artists wire and rests just external of the open end of elongated container 1, silver colored latex tubing, (i.e., the end without the outlet component 16, ¼ inch nylon barbed coupling. The elongated container 1, silver colored latex tubing is now filled with Bath & Body Works Black Currant and Vanilla Moisturizing Hand Cream by moving aside the tethered movable dispensing component 10, 7 mm red glass bead, and joining the bottle nozzle to the open end of elongated container 1, silver colored latex tubing, and squeezing the lotion into the elongated container 1, silver colored latex tubing. The elongated container 1, silver colored latex tubing, holds about 0.10 ounces and can be observed coming out the exposed end of outlet component 16, ¼ inch nylon barbed coupling, when elongated container 1, silver colored latex tubing, is full. The tethered movable dispensing component 10, 7 mm red glass bead, is then pushed into the open end of elongated container 1, silver colored latex tubing, approximately ½ inch. The exposed end of Outlet component 16, ¼ inch nylon barbed coupling, is then pushed into the open end of elongated container 1, silver colored latex tubing forming a closed bracelet. The bracelet is then slipped over the hand and worn on the wrist. To access the lotion inside the bracelet do the following: Slip the bracelet over the hand and off of the wrist. Open the bracelet: Pull apart at outlet component 16, ¼ inch nylon barbed coupling. Note that the side with Binding component 14, #7 black o-ring is now fixed. Dispense: manipulated tethered movable dispensing component 10, 7 mm red glass bead, through tube to dispense contents. Closing: Replace movable dispensing component 10, 7 mm red glass bead, in elongated container 1, silver colored latex tubing. The exposed end of Outlet component 16, ¼ inch nylon barbed coupling, is then pushed into the open end of elongated container 1, silver colored latex tubing again forming a closed bracelet.

It is suggested to clean the device between fillings and when changing contents, etc. . . . Cleaning: Open. If the elongated container 1, silver colored latex tubing is not empty, dispense the unused Bath & Body Works Black Currant and Vanilla Moisturizing Hand Cream back into the original container or into a disposal, by following the aforementioned dispensing directions. Then remove tethered movable dispensing component 10, 7 mm red glass bead, from the elongated container 1, silver colored latex tubing, by manipulating it back out the the open end of elongated container 1, silver colored latex tubing, Run hot water from faucet through elongated container 1, silver colored latex tubing. If necessary, use a Q-tip or a pipe-cleaner inside the elongated container 1, silver colored latex tubing to loosen any stuck lotion.

Example 2

Types of Fluids Used in the Bracelet for Storing and Dispensing Fluids

Suitable fluids that have been stored and dispensed from the preferred embodiment (e.g., a bracelet made according to Example 1) include:

Lotions: Bath & Body Works—Black Currant Vanilla Moisturizing Hand Cream; Jack Black Skincare; Guess Body Lotion; Victoria's Secret—Very Sexy Body Lotion; Palmers Cocoa Butter; Aveda Botanical Kinetics Skincare; Burt's Bees After Sun Soother.

Hand Sanitizers: All Terrain Hand Sanz Antiseptic Hand Sanitizer; Bath & Body Works Pocket Bac Anti-Bacterial Hand Gel.

Sun Screens & Blocks: Coppertone Sport SPF 30; Jason Active Block SPF 40; Jason Family Block SPF 36; Banana Boat Natural Chemical Free Sunblock SPF 25; Alba Botanical Mineral Sunscreen SPF 10; Avon Skin-So-Soft SPF 30 w/Bug Repellent.

Insect Repellents & Analgesic: Bite Blocker Organic; Caladryl Cream.

Personal Lubricants: Durex Play Passion Cherry Intimate Lubricant.

Energy Gels: Power Bar Energy Gel, Strawberry Banana.

Lip Glosses: Aquafina Hydrating Lip Oil, Wild Berry.

Make-ups: Aveda Tinted Moisture SPF 15.

Shampoo & Conditioners: Bath & Body Works Volumizing Shampoo & Conditioner.

Toothpastes: Crest 3D White.

Shaving Gels: Aveeno Therapeutic Shave Gel.

Liquid Hand Soaps: Gojo Hand Soap; Softsoap Liquid Hand Soap.

Liquid Body Soaps: Axe Revitalizing Shower Gel.

Liquid Dish Soaps: Ultra Palmolive Aroma Sensations Dish Soap.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A device for storing and dispensing a fluid, said device comprising:

(a) an elongated container comprising a hollow body having an open first end and an open second end, wherein the first and second ends of the container are configured to allow for their direct or indirect connection, so that when the first and second ends are connected, the elongated container is in the form of a closed ring-like structure effective for storing the fluid;

(b) an outlet component directly or indirectly attached to the first end of the elongated container, wherein the outlet component is effective as a conduit for dispensing a fluid from the elongated container; and (c) a movable dispensing component effective for manipulating the fluid through the elongated container and for dispensing the fluid from the outlet component, wherein the movable dispensing component is configured to be movably disposed within the container, said movable dispensing component comprising a substantially solid structure containing a pore that extends through the center of the substantially solid structure, and said movable dispensing component being anchored directly or indirectly to the elongated container by a filament having a first terminal end and a second terminal end, wherein the filament is of a length to allow the movable dispensing component to be exported from the second end of the elongated container while still being anchored to the elongated container, wherein the pore facilitates tethering of the movable dispensing component to the filament, and wherein the filament slackens as the movable dispensing component is manipulated toward the outlet component.

2. The device according to claim 1, wherein the movable dispensing component, when movably disposed within the container, is effective to create a fluid partition of the container and a vacant partition of the container, wherein the fluid partition is the portion of the container's hollow body that is terminally defined by the first end of the container and the movable dispensing component, and wherein the vacant partition is the portion of the container's hollow body that is terminally defined by the second end of the container and the movable dispensing component.

3. The device according to claim 1, wherein the fluid has a viscosity that is equal to or greater than the viscosity of water at room temperature.

4. The device according to claim 1, wherein the fluid is selected from the group consisting of sunblock, sunscreen, after-sun-care, lotions, topicals, moisturizer, sanitizer, insect repellent, personal lubricant, hand soap, body soap, shaving cream, shampoo, hair conditioner, toothpaste, cosmetics and perfumes, essential oils, body oils, pharmaceutical mixtures, nutritional mixtures, edible fluid mixtures, energy gels, body camouflage, body paint, face paint, artistic paints, and glues.

5. The device according to claim 1, wherein the elongated container is made from a material selected from the group consisting latex, silicone, plastic, rubber, copolymers (e.g., thermoplastic elastomers, thermoplastic rubbers), neoprene, metal, fabric, paper, and wood.

6. The device according to claim 1, wherein the outlet component comprises a hollow tube having a base end and a dispenser end, wherein the base end of the outlet component is directly or indirectly attached to the first end of the elongated container.

7. The device according to claim 6, wherein the outlet component is configured so that the dispenser end is tapered, barbed, tapered and barbed, a rollerball configuration, and/or includes an internal check valve.

8. The device according to claim 6, wherein the outlet component is configured so that both the dispenser end and the base end are tapered, barbed, or tapered and barbed.

9. The device according to claim 1, wherein a connector component is attached to the second end of the elongated container, and wherein the connector component is configured to couple to the outlet component.

10. The device according to claim 9, wherein the outlet component is a male end and the connector component is a corresponding female end.

11. The device according to claim 9, wherein the dispenser end of the outlet component is configured to connect to the second end of the elongated container so that the elongated container forms a closed ring-like structure.

12. The device according to claim 6, wherein the base end of the outlet component is attached to the first end of the elongated container by a binding component.

13. The device according to claim 12, wherein the binding component is an O-ring.

14. The device according to claim 2, wherein the movable dispensing component has a shape effective (i) to create the fluid and vacant partitions of the container and (ii) for manipulating the movable dispensing component through the container so as to move the fluid through the container.

15. The device according to claim 1, wherein the movable dispensing component has a shape selected from the group consisting of spherical, round, oblong, oval, teardrop, conical, rondelle, and irregular.

16. The device according to claim 1, wherein the movable dispensing component is made of a material selected from the group consisting of glass, plastic, stone, bone, horn, ivory, metal, shell, pearl, coral, gemstones, polymer clay, metal clay, resin, synthetic minerals, wood, ceramic, and fiber.

17. The device according to claim 1, wherein the movable dispensing component is a bead.

18. The device according to claim 6, wherein the first terminal end of the filament is attached to the base end of the outlet component and the second terminal end of the filament is attached to the movable dispensing component.

19. The device according to claim 1, wherein the filament is selected from the group consisting of single and/or multifilament artistic wire, jewelry wire, fishing line, and multifilament line.

20. The device according to claim 1, wherein the elongated container, when in the form of a closed ring-like structure, is adapted for being worn as a bracelet on the wrist of an individual, as an armlet on the arm of an individual, as an anklet on the ankle of an individual, as a necklace around the neck of an individual, as a waistband around the waist or hips of an individual, or as a removable attachment to an inanimate object.

21. The device according to claim 1 further comprising:

one or more embellishment selected from the group consisting of charms, stones, gems, ornaments, and precious metals.

22. A kit comprising:

(a) the device according to claim 1; and (b) a filling attachment comprising an attachment end and an adapter end, wherein the attachment end is configured to insert a fluid into the elongated container, and wherein the adapter end is configured to connect to a reservoir containing the fluid prior to the fluid being inserted into the elongated container.

23. A kit comprising:

a compilation of component parts comprising the elongated container, the outlet component, and the movable dispensing component of the device according to claim 1.

24. A method for storing a fluid, said method comprising:

providing a device according to claim 1, wherein said device contains the fluid and is provided so that the first end and second end of the elongated container are connected so as to form a closed ring-like structure, thereby storing the fluid.

25. A method for storing, dispensing, and refilling a fluid, said method comprising:

providing a device according to claim 1, wherein said device contains the fluid and is provided so that the first end and second end of the elongated container are connected so as to form a closed ring-like structure, thereby storing the fluid;

disconnecting the first end and second end of the elongated container;

manipulating the movable dispensing component in a direction toward the first end of the elongated container so that the fluid is expelled from the outlet component; and refilling the elongated container with unused fluid.

* * * * *